US007628412B2

(12) United States Patent
Colon

(10) Patent No.: US 7,628,412 B2
(45) Date of Patent: Dec. 8, 2009

(54) SKATEBOARD

(75) Inventor: Becket Colon, Vallentuna (SE)

(73) Assignee: Performance Sk8 Holding Inc., Valentuna (SE)

( * ) Notice: Subject to any disclaimer, the term of this patent is extended or adjusted under 35 U.S.C. 154(b) by 0 days.

(21) Appl. No.: 12/189,520

(22) Filed: Aug. 11, 2008

(65) Prior Publication Data

US 2008/0296859 A1 Dec. 4, 2008

Related U.S. Application Data

(60) Division of application No. 11/203,143, filed on Aug. 15, 2005, now Pat. No. 7,410,181, which is a continuation of application No. 10/431,563, filed on May 8, 2003, now abandoned, which is a continuation of application No. 09/440,856, filed on Nov. 16, 1999, now Pat. No. 6,565,104.

(30) Foreign Application Priority Data

Nov. 16, 1998 (SE) ..... 9803900
Mar. 18, 1999 (SE) ..... 9900975

(51) Int. Cl.
*B62M 1/00* (2006.01)

(52) U.S. Cl. ..... 280/87.042; 280/809

(58) Field of Classification Search ..... 280/87.021, 280/87.041, 87.042, 14.21, 811, 608, 609, 280/610, 809, 87.01
See application file for complete search history.

(56) References Cited

U.S. PATENT DOCUMENTS 3,374,495 A 3/1968 Joyce
3,481,619 A 12/1969 Powers
4,040,639 A 8/1977 Scardenzan
4,140,326 A 2/1979 Huber
4,149,735 A 4/1979 Blackburn et al.
4,180,278 A 12/1979 Gottlieb
4,182,520 A 1/1980 Stevenson
4,199,165 A 4/1980 Spitzke
4,834,407 A * 5/1989 Salvo ..... 280/87.042
4,896,893 A 1/1990 Shumays et al.
4,997,196 A 3/1991 Wood (Continued)

FOREIGN PATENT DOCUMENTS

CH 616 854 4/1980

(Continued)

OTHER PUBLICATIONS

Shock Skateboard Advertisement, New Nose Guard (undated).

*Primary Examiner*—Lesley D. Morris
*Assistant Examiner*—Brian Swenson
(74) *Attorney, Agent, or Firm*—Buchanan Ingersoll & Rooney PC

(57) ABSTRACT

A kicktail concave skateboard includes a blank having opposite ends, at least one end being recessed. An element is mounted on the recessed end such that a portion of the element adjoining the blank is flush with the blank. The element is formed of a material having a lower mechanical damping capacity and a higher modulus of elasticity than the blank. The element includes a downwardly facing exposed side having a downward projection thereon, to facilitate the execution of an "ollie" maneuver.

2 Claims, 8 Drawing Sheets

U.S. PATENT DOCUMENTS

| | | | | |
|---|---|---|---|---|
| 5,002,294 | A | 3/1991 | Franz | |
| 5,080,382 | A | 1/1992 | Franz | |
| 5,119,277 | A | 6/1992 | Copley et al. | |
| 5,242,322 | A | 9/1993 | Chellemi et al. | |
| D343,436 | S | 1/1994 | Park | |
| 5,947,495 | A | 9/1999 | Null et al. | |
| 5,984,328 | A | 11/1999 | Tipton | |
| 6,012,734 | A | 1/2000 | Skedeleski | |
| 6,036,218 | A | 3/2000 | Muff, Jr. | |
| 6,059,307 | A | 5/2000 | Western | |
| 6,059,315 | A | 5/2000 | Selph | |
| 6,182,986 | B1 | 2/2001 | Smith | |
| 6,199,880 | B1 | 3/2001 | Favorito et al. | |
| 6,203,037 | B1 | 3/2001 | Wilson et al. | |
| 6,293,571 | B1 | 9/2001 | Wen | |
| 6,450,512 | B1 | 9/2002 | Carr | |
| 6,565,104 | B1 | 5/2003 | Colon | |
| 6,945,563 | B2 * | 9/2005 | Clausing | 280/809 |
| 2003/0160410 | A1 | 8/2003 | Yang | |
| 2005/0127630 | A1 * | 6/2005 | Kuhlman et al. | 280/87.042 |

FOREIGN PATENT DOCUMENTS

| | | |
|---|---|---|
| DE | 20204254 | 7/2002 |
| FR | 2 396 570 | 2/1979 |
| GB | 2346561 | 8/2000 |

* cited by examiner 3
1

3
5

B
B
3
5
1

W
L
H
1
3
T 1
1a
4
5
3

SKATEBOARD

This application is a division of application Ser. No. 11/203,143 filed on Aug. 15, 2005, which is a continuation of application Ser. No. 10/431,563 filed on May 8, 2003, which is a continuation of application Ser. No. 09/440,856 filed on Nov. 16, 1999, and now U.S. Pat. No. 6,565,104 issued on May 20, 2003.

TECHNICAL FIELD OF THE INVENTION

The present invention refers to a kicktail concave skateboard, which in the area of at least one of its end portions is equipped with an element of a different material than the rest of the skateboard, said element having a side that in the position of use of the skateboard faces towards the ground, and that the element is manufactured of a material that has a lower mechanical damping capacity and a higher modulus of elasticity than the rest of the material of the skateboard. In addition, the invention also refers to the element itself, to a blank for a skateboard and to a method for manufacturing a blank for a skateboard according to the present invention. A definition of a kicktail concave skateboard is given below in the detailed description of the invention.

PRIOR ART

Skateboarding has changed dramatically in the past decade. In the late 80s the maneuver known as an "ollie" was invented and has evolved to become the foundation of the modern sport. Every skateboard maneuver today is initiated with an ollie. An ollie enables the rider (and board) to become airborne to execute acrobatic maneuvers or clear obstacles. To perform an ollie the tip of the board is slammed against the riding surface and the skateboard "pops" in the air. While in the air the board is skillfully manipulated with the rider's feet in order to execute the desired trick or maneuver. The degree of energy transfer is central to the successful execution of the ollie. Execution of ollies causes severe wear to the tips of traditional skateboards. The wear compromises the structural integrity of the skateboard's tips and reduces the energy transfer rate between the tip and the riding surface. A new board has intact tips, maximizing the energy transfer (pop). As the tips wear, board performance diminishes due to a weaker structure and increased friction. The more significant the wear, the poorer the board's performance.

Modern skateboards are made of laminated maple, a material with poor mechanical properties (not especially hard and/or wear resistant, prone to humidity). The tips of the boards wear quickly. Ridden daily, the board has a functional life of 2-3 weeks. Worn tips not only require more frequent board replacement, but also affect the learning curve. Execution of modern-day tricks depends on predictable and reliable board performance. Professional skateboarders realize this and change their equipment regularly in some instances as often as every 2-3 days.

Every time an "ollie" is executed, a part of the nose or tail of the skateboard is worn off. The larger wear upon the nose and the tail (i.e. the portions that come in contact with the ground when an "ollie" is executed) the worse the performance of the skateboard when executing an "ollie". The reason is that a new skateboard has a well-defined nose and tail, which means that the contact area against the ground is well-defined and relatively small. This concentrates the power transfer and provides a high degree of energy exchange, i.e. the energy that is transferred from the ground to the skateboard. As the nose and tail of the skateboard wear, i.e. the contact surface grows in size and becomes structurally less well defined, a loss of performance is experienced when executing an "ollie". When the energy is spread over a larger area, a lower degree of energy exchange is experienced which results in less height and power in the "ollie". Significant wear of the nose and tail of the skateboard makes it impossible to execute an "ollie". For an advanced rider this means that the skateboard must be disposed of.

There have been skateboards which have been equipped with fittings or the like in the area of the nose and tail. These fittings have not been constructed of material which has stimulated the energy transfer between the ground and the skateboard. Said fittings have primarily been intended to function as brake pads or as protection devices for the nose and tail. Said fittings have neither been structurally integrated into the skateboard (and have therefore impaired nose and tailslide performance), nor intended to improve the performance of the skateboard.

From U.S. Pat. No. 4,140,326 a modified kicktail skateboard is previously known. At least at one end of said skateboard a wedge member is mounted as an external element. However, the purpose of said wedge member is primarily to "convert a 1970's style flat skateboard to a kicktail board" as well as preventing wear of the end portions of the skateboard. A wedge member of the kind disclosed in U.S. Pat. No. 4,140,326 will not function if the rider wants to perform an "ollie". This 1970's-era skateboard lacks a concave riding surface necessary to perform the different types of rotational ollie maneuvers as well as the fundamental deformation zone located in the beginning of the kicktail areas of the board. In addition the wedge member considerably reduces the distance between the end portion and the ground. This particular design impairs nose and tailslide performance and does not allow the board to attain a sufficient contact angle necessary to "pop" the board in the air. The wedge design also significantly affects the amount of accumulated rotational energy attained when the end portion of the board makes contact with the ground. This subsequently reduces the amount of energy entering the board compared to a modern skateboard having built in kicktail design.

From U.S. Pat. No. 4,040,639 a kicktail skateboard is previously known, said skateboard being equipped with a braking pad at its lower side. A portion of said brake pad is recessed in the skateboard while a major portion of said brake pad projects beyond the skateboard. A skateboard equipped with such a brake pad is not suitable for performing "ollie" maneuvers for the same reasons as set out above in connection with U.S. Pat. No. 4,140,326.

OBJECTS AND FEATURES OF THE INVENTION

A primary object of the present invention is to provide a skateboard, which exhibits improved performance, especially when the rider executes a so-called "ollie"-maneuver.

A further object of the present invention is to structurally modify a skateboard at its nose and tail in order to extend the lifetime of said skateboard, especially as regards the execution of an "ollie"-maneuver.

A further object of the present invention is that the modification of the skateboard does not interfere with nose and tail slide maneuvers.

Still a further object of the invention is that the structural design of the nose and tail of the skateboard is structurally reliable in connection with the forces acting upon the skateboard when performing ollie maneuvers.

Yet a further object of the invention is that the structural modification of the skateboard in a simple way may be integrated in the manufacturing procedure of the skateboard, alternatively that it may be executed in the shape of a renovation of a skateboard.

At least the primary object of the present invention is attained by a kicktail concave skateboard which comprises a blank having opposite ends, and top and bottom sides. At least one of the ends is of reduced thickness to define a recess in at least the bottom side thereof. An element is mounted in the recessed end such that a portion of the element adjoining the blank has a thickness substantially equal to a depth of the recess, whereby the portion of the element adjoining the blank is flush therewith. The element includes a downwardly facing exposed side. The element is formed of a material having a higher modulus of elasticity than the blank.

The invention also pertains to the element per se, and to the blank per se, as well as to a method of making the blank.

BRIEF DESCRIPTION OF THE DRAWINGS

Below embodiments of a skateboard/an element according to the present invention will be described, reference being made to the accompanying drawings, where.

DETAILED DESCRIPTION OF PREFERRED EMBODIMENTS OF THE INVENTION

The present invention relates to a kicktail concave skateboard S, i.e. a skateboard which includes a blank 7 having upwardly inclined end portions, a bottom surface 2, and a top surface defining a concave riding surface. The basic shape of such a skateboard blank is disclosed in FIGS. 14 and 15.

Figures 1, 2, 3A, 3B, 3C:
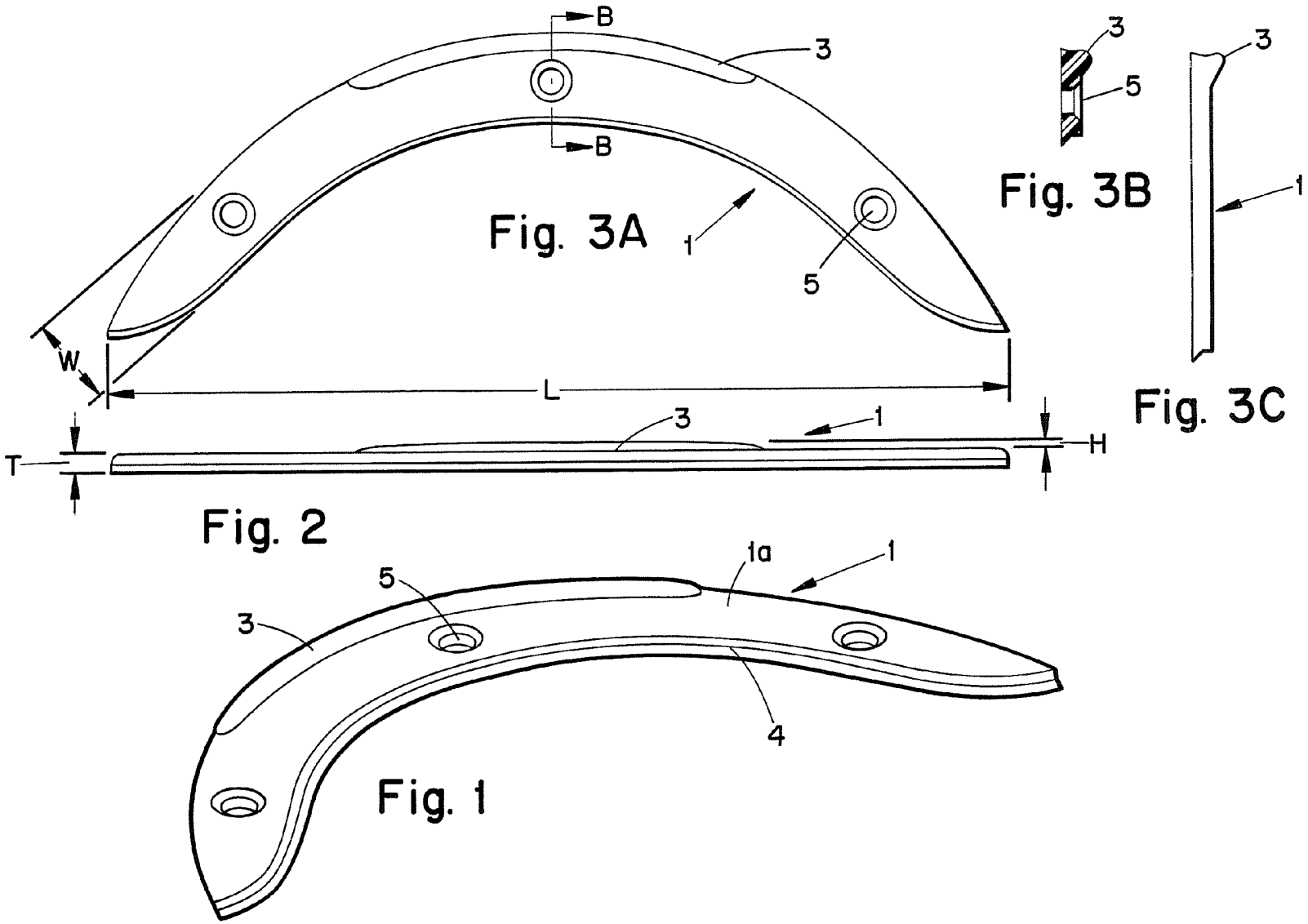
FIG. 1 shows a perspective view of an element according to the present invention, said element being used to provide a modification of the nose and tail of the skateboard.
FIG. 2 shows a side view of the element according to FIG. 1.
FIG. 3A shows a top view of the element according to FIG. 1.
FIG. 3B shows a section taken along line B-B in FIG. 3A.
FIG. 3C shows an end view of the element according to FIG. 3A.

The element 1 disclosed in FIGS. 1-3 constitutes a generally planar, curved plate 1*a* having a relatively smaller width W in comparison to its length L. The shape of the element 1 is adapted to the skateboard that the element is mounted upon. That is, the element is curved as viewed from beneath the skateboard.

As is evident from FIGS. 1-3 the generally flat plate 1*a* is of generally uniform thickness T which at one longitudinal edge is provided with a portion 3 projecting downwardly from the plane of the plate 1*a*, said portion having a curvature extending along only part of the entire curved length of the plate 1*a*. Preferably, said first projecting portion 3 has a curved extension along 10%-35% of the total curved length of the plate 1*a*. Said first projecting portion 3 covers a surface that constitutes only a relatively small part of the downwardly facing side of the plate 1*a* that receives the projecting portion 3. Said first projecting portion 3 has a height H in a direction perpendicular to the main plane of the plate 1*a*, said height preferably constituting 50%-100% of the thickness T of the flat part of the of the plate 1*a*. Said first projecting portion 3 has generally a rounded shape at its free or lower edge (see FIG. 3C).

At a longitudinal edge of the plate 1*a*, located opposite to the longitudinal edge where said first projecting portion 3 is located, a notch 4 is provided, see especially FIGS. 3B and 3C. The function of said notch 4 will be explained more in detail below in connection with the description of the mounting of the element 1 on the blank 7.

As is evident from FIGS. 1-3 the element 1 is provided with a number of (three in the shown embodiment), first throughholes 5 that are adapted to accommodate fastening means by which the element 1 is fastened to the blank 7. Said first holes 5 are preferably formed by means of drilling and are recessed (counterbored) at the side of the element 1 that faces outwards (downwards) in the mounted position of said element 1.

The material of the element 1 should generally have a low damping coefficient, a high impact strength and should also be durable/wear resistant. The material should also have a modulus of elasticity that is higher than the modulus of elasticity for the rest of the material of the skateboard, i.e., higher than that of the skateboard blank 7. According to a preferred embodiment, the element 1 is manufactured from polyamide plastic (nylon) but within the scope of invention other materials are also feasible that have low mechanical damping, high modulus of elasticity, high impact strength and high wear resistance. In exemplifying and non-restricting purpose the plastic materials PEHD (high density polyethylene), PUR (polyurethane), POM (polyoxy methylene), PETP (polyethylene terephthalate) and hard wood may be mentioned.

Figure 4:
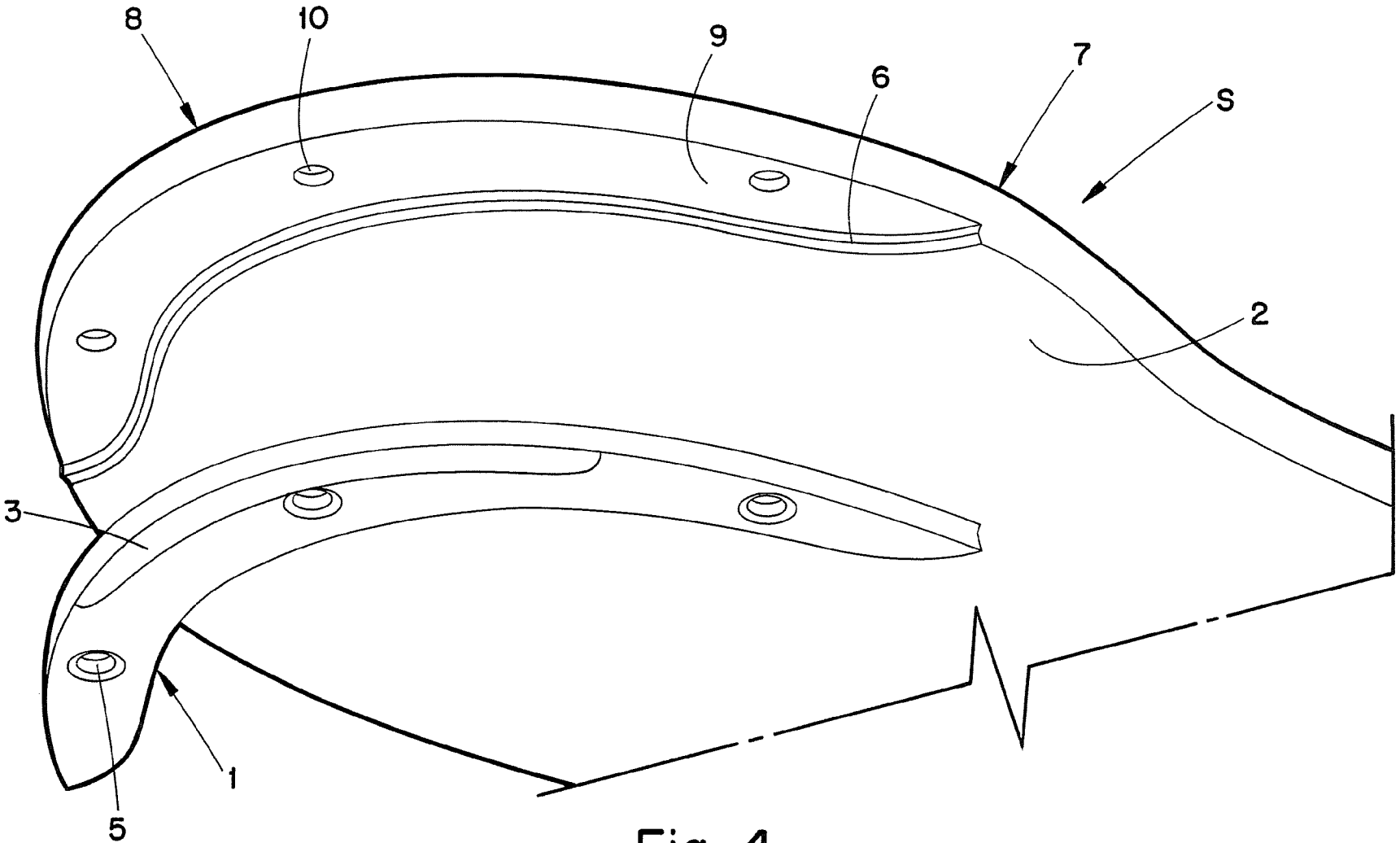
FIG. 4 shows in perspective an exploded view of a skateboard prepared for mounting of an element, also shown, at an end portion of said skateboard.

The end portion 8 of the blank 7 shown in FIG. 4 is of reduced thickness to define a recess in the lower side 2 of the blank 7. Said recess 9 has a shape that is curved as viewed from below the skateboard, the curvature corresponding to that of the element 1 that, as pointed out above, is adapted to the curvature of the end of the blank 7. Especially, the curvature of the element 1 is adapted to the radius of curvature of the adherent end portion of the blank 7. Generally, it can be said that the dimensions of the element 1 correspond to the dimensions of the recess 9. The recess 9 is also provided with a projection 6 that is intended to cooperate with the notch 4 of the element 1. This will be illuminated more in detail below in connection with the description of the mounting of the element 1 upon the blank for a skateboard. Normally, the recess 9 is formed as a step in the manufacturing of the blank 7. It should the mentioned in this connection that when manufacturing the actual blank 7, said blank is usually built up by crosswise lamination of layers of pressed maple. When this blank is ready for machining, the recess 9 is formed in the blank.

As is evident from FIG. 4 the recess 9 is provided with a number of (in the shown embodiment three) second through-holes 10 that are located in such a way that when the element 1 is mounted in the recess 9, the first holes 5 are aligned with the respective second holes 10. Normally the second holes 10 are effected by means of drilling.

Figure 5:
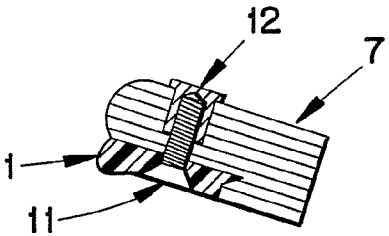
FIG. 5 shows a section through an end portion of the skateboard according to the present invention.

In connection with mounting of the element 1, said element 1 is placed in the recess 9 and fastened by means of suitable fastening means, preferably tubular screws 11 (see FIG. 5), that are received in the first and second holes 5 and 10, respectively. In the holes 10, at the side of the blank 7 facing away from the recess 9, tubular sleeves 12 are inserted, said tubular screws 11 being received in said tubular sleeves 12 (see FIG. 5). The holes 5 are counterbored so that the heads of the screws normally do not protrude outside of the element 1. Since in connection with said mounting, the projection 6 of the blank 7 is received in the notch 4 of the element 1, there is a cooperation between the element 1 and the blank 7, said cooperation effecting a reinforcement of the edge portion 8. This is extremely beneficial in connection with absorbing and transferring of the forces that are generated in connection with an "ollie"-maneuver. Generally, it can be said that the element 1 fills out the recess 9, i.e. the volume of the material taken away in connection with creating the recess 9 in principle corresponds to the volume of the element 1. A depth of the recess where the element 1 adjoins the bottom surface 2, i.e. along the projection 6, is the same as the thickness of the plate 1*a*. This means that a flush relationship of the element 1 to the adjacent portions of the blank 7 is effected.

As a complement to the fastening means/tubular screws, it is feasible within the scope of the invention to provide an adhesive or the like between the element 1 and the recess 9. The skateboard according to the present invention is thus provided with an element 1 at least at one end portion 8 but preferably at both end portions of the blank. This means that another element 1, as has been described above, would be mounted in a recess 9 located also at the other end portion of the blank. At least one element 1 thus constitutes at least a part of the edge portion of the skateboard according to the present invention.

It is realized by viewing FIGS. 1-4 that when a rider is about to perform an "ollie" and the end portion 8 of the skateboard that is equipped with the element 1 is pushed down towards the ground, the free (lower) end of the first projecting portion 3 comes into contact with the ground and an energy transfer may take place between the ground and said first projecting portion 3. Generally, the element 1 and consequently also the first projecting portion 3 are manufactured from a hard, wear resistant material, preferably reinforced polyamide plastic. This means that the wear of the first projecting portion 3 proceeds extremely slowly. Despite this, a gradual wear of the first projecting portion 3 takes place. However, in this connection it should be noticed that even if said first projecting portion 3 is worn, the contact surface against the ground does not increase until the entire first projecting portion 3 has been worn away. However the skateboard may still be used when said first projecting portion 3 has been worn flat although a deteriorated diminishing performance is achieved when executing "ollies".

When the first projecting portion 3 has been worn flat, the skateboard may, in a simple way, be equipped with a new element 1. The existing element 1 is dismounted by removing the fastening means/tubular screws. By replacing the worn out element 1 the skateboard has been renovated in a simple and functional way, as it is the nose and tail that are subjected to the most wear.

Figure 6B:
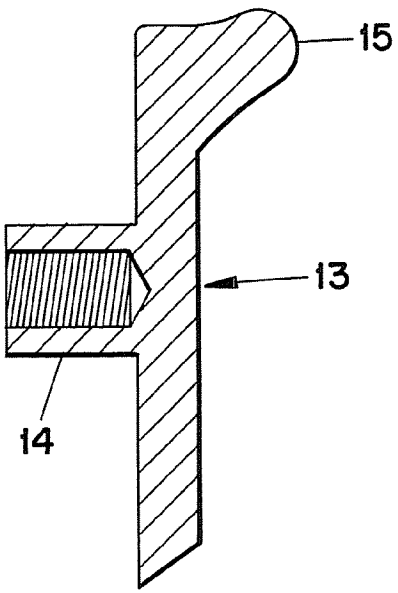
FIG. 6B shows in a larger scale a section taken along line C-C in FIG. 6A.
Figure 6A:
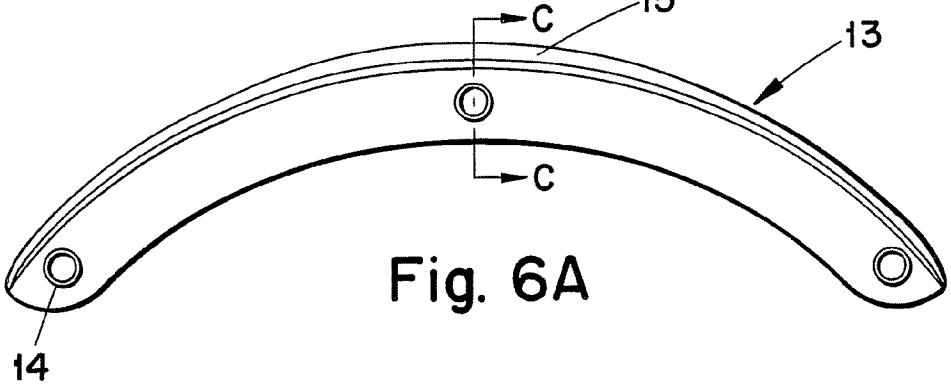
FIG. 6A shows a top view of a mounting element that in certain cases may be used for fastening of the element.
Figure 7:
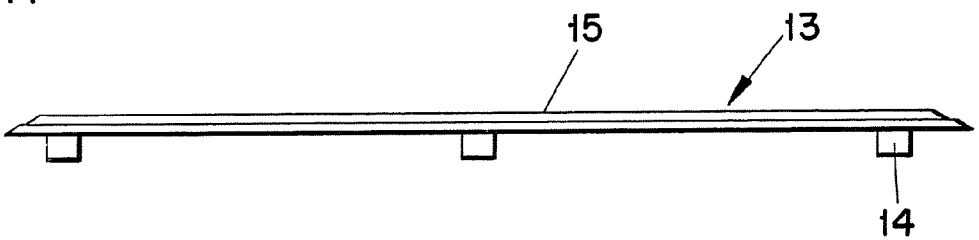
FIG. 7 shows a side view of the mounting element according to FIG. 6A.

In FIGS. 6A, 6B and 7, a mounting element 13 is provided in order to further improve the reliability of the mounting of the element 1. The mounting element 13 is generally in the shape of a plate and has elongated, curved shape. The mounting element 13 has preferably a basic shape that in principle corresponds to the basic shape of the element 1. The mounting element 13 is provided with a number of internally threaded tubular pieces 14, said pieces 14 in the shown embodiment being integral with the mounting element 13, see especially FIG. 6B. The number of tubular pieces are three in the shown embodiment, i.e. they correspond to the number of holes 10 in the blank 7. The mounting element 13 is provided with a second projecting portion 15, said portion 15 extending along the major part of the length of the mounting element 13. However the height of the projecting portion 15 declines in direction towards the free ends of the mounting element 13.

Figure 8:
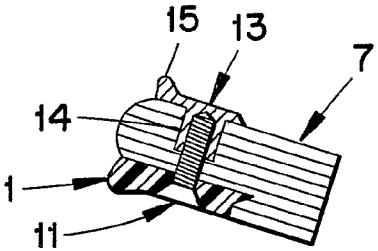
FIG. 8 shows the section through an end portion of the skateboard according to the present invention, said skateboard being provided with a mounting element according to the present invention.

In FIG. 8 it is shown how the mounting of the element 1 is effected by means of the mounting element 13. Thereby, the element 1 is in a usual way received in the recess of the blank 7 and the tubular pieces 14 of the mounting element 13 are received in through-holes in the blank 7. Tubular screws 11 extend through the element 1 and are received in said tubular pieces 14. Thereby, a durable and reliable fastening of the element 1 is achieved in the recess of the blank 7 for a skateboard.

In connection with the description above, the importance of the first projecting portion 3 has been emphasized. Said portion 3 is extremely important when the rider executes non-rotational "ollie"-maneuvers and other street related maneuvers. However, there are also riders who primarily execute rotational ollies or who ride ramps and therefore said first projecting portion 3 is of less importance for them. Despite this, it is preferable to have a similar type of element, that possibly may be void of said first projecting portion 3, since it is in principle always the nose and tail of the skateboard, regardless of the type of riding, that are subjected to the most wear. Examples of maneuvers where an element without a first projecting portion is of importance, include nose and tail slides, i.e., when the rider slides sideways on the front and rear end portions 8 of the skateboard as well as rotational ollies i.e. when the rider kicks down on the side portions of the tail (immediately to the left or right of portion 3).

Figure 9:
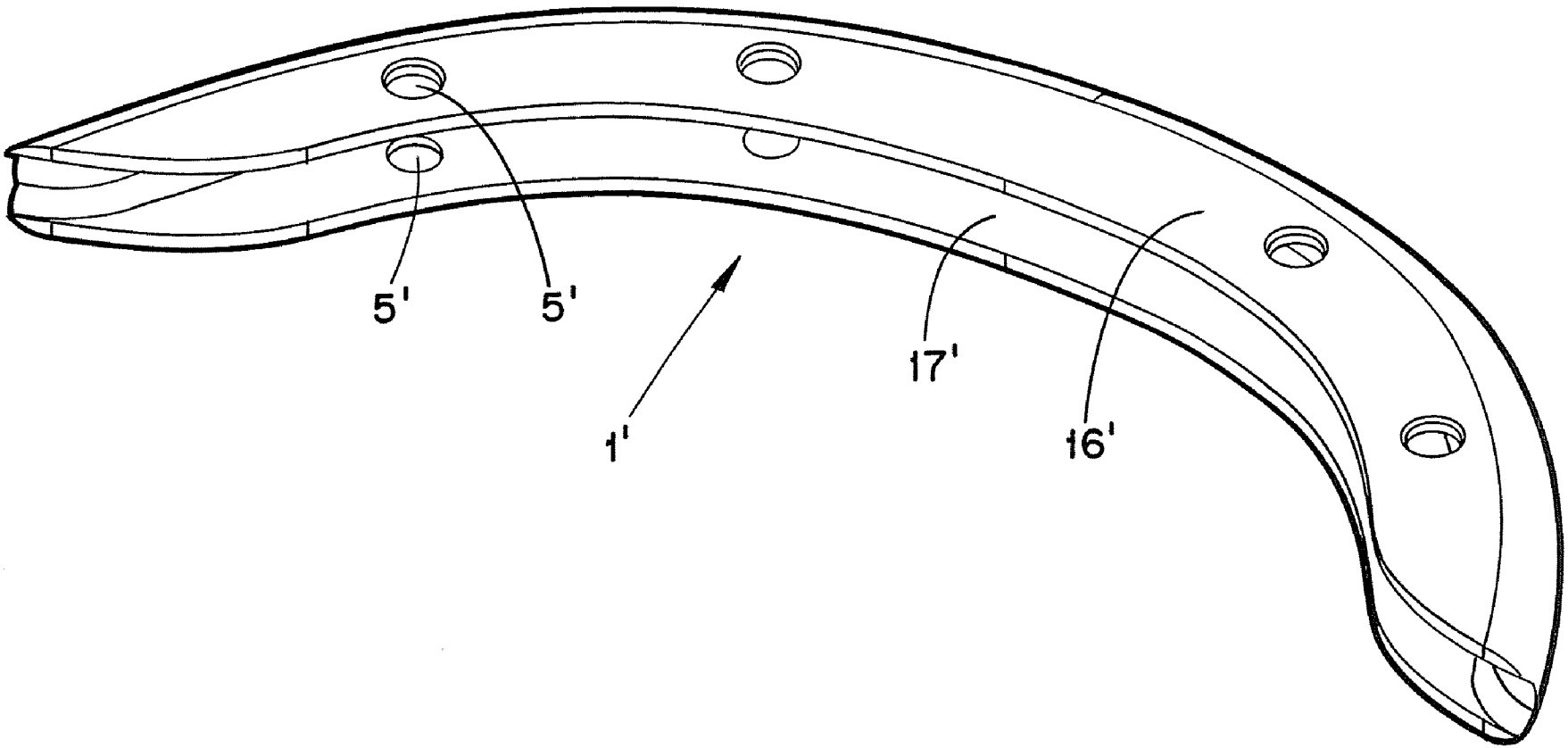
FIG. 9 shows a perspective view of an alternative embodiment of an element according to the present invention.

An alternative embodiment of an element 1' according to the present invention, (shown in FIGS. 9 and 10) has a generally curved shaped and is intended to be mounted at an end portion of a skateboard. Unlike the element 1 the element 1' is in the shape of a cover/cap, i.e. it has a U-shaped cross section. Thus, said element 1' has a first side wall 16' and a second side wall 17' said side walls 16' and 17' preferably being parallel to each other and connected with each other by means of a bridging element 18' (see FIG. 10). The side walls 17' and 18' constitute planar, plate-like elements of generally uniform thickness. In a mounted position of the element 1' the side walls 16', 17' surround the end portion of the blank for a skateboard, both on its upper side and its lower side. The bridging element 18' will cover the edge portion of the blank, said edge portion extending between the upper side and the lower side of the blank.

Figure 10:
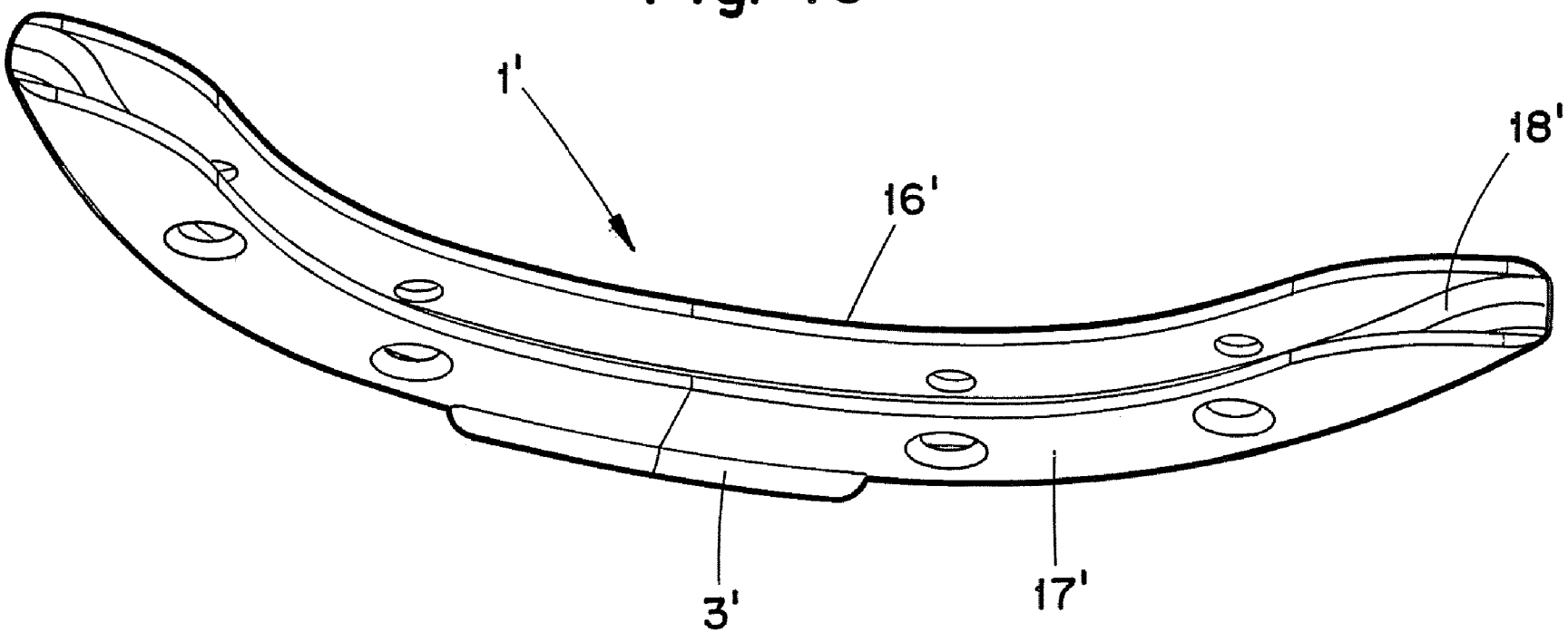
FIG. 10 shows a view from behind of the element according to FIG. 9.

As is evident from FIG. 10, the element 1' is equipped with a projecting portion 3' at its second side wall 17', said projecting portion 3' having the corresponding function as the portion 3 in connection with the embodiment according to FIGS. 1-4.

Figure 11:
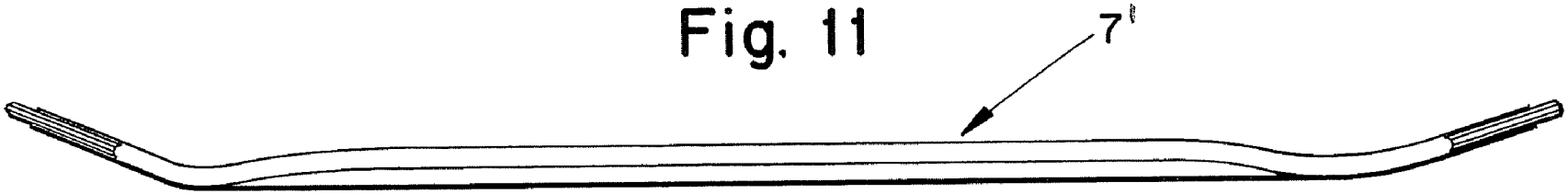
FIG. 11 shows a side view of a blank for a kicktail concave skateboard.
Figure 12:
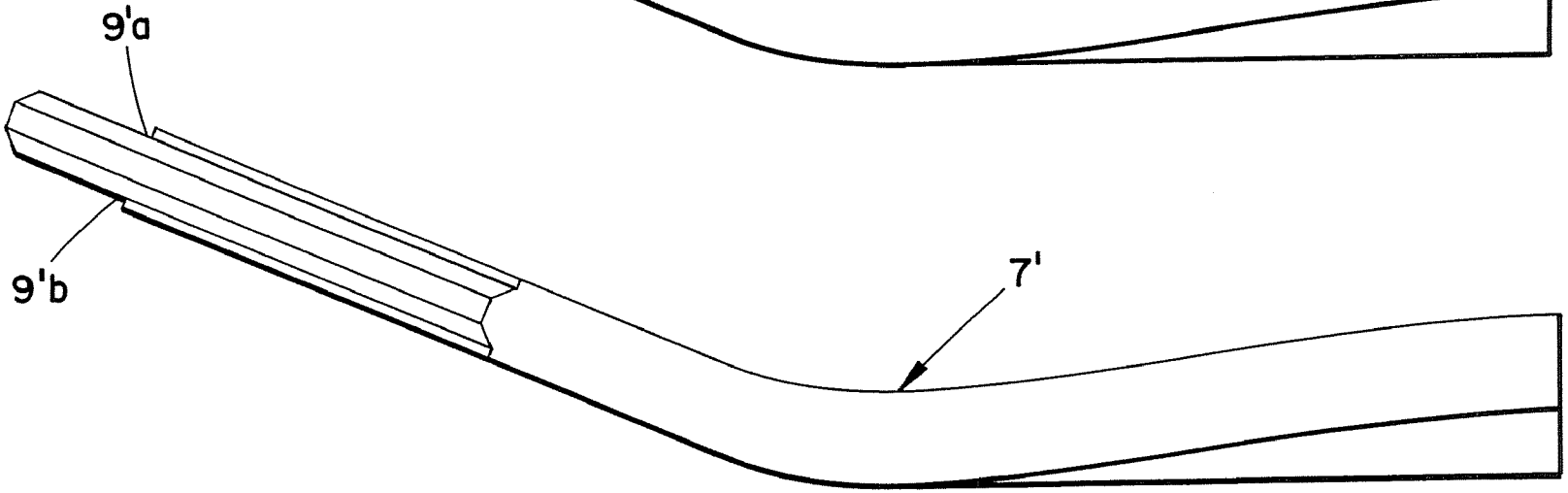
FIG. 12 shows in detail a side view of an end portion of the blank according to FIG. 11.

The element 1' is mounted upon a blank 7' according to FIG. 11, said blank 7' being equipped with recessed end portions where material has been taken away, i.e. recesses are created in both the upper and lower sides of the blank 7'. Said recesses 9'*a* and 9'*b* are shown more in detail in FIG. 12. The recesses 9'*a* and 9'*b* correspond to the recess 9 in the earlier described blank 7 according to FIG. 4 in that they serve to receive the element 1'.

In a corresponding way as in connection with the element 1 according to FIGS. 1-4, the element 1' is provided with first holes 5' in order to fasten the element 1' to the blank 7' by means of for instance screws.

Figure 13:
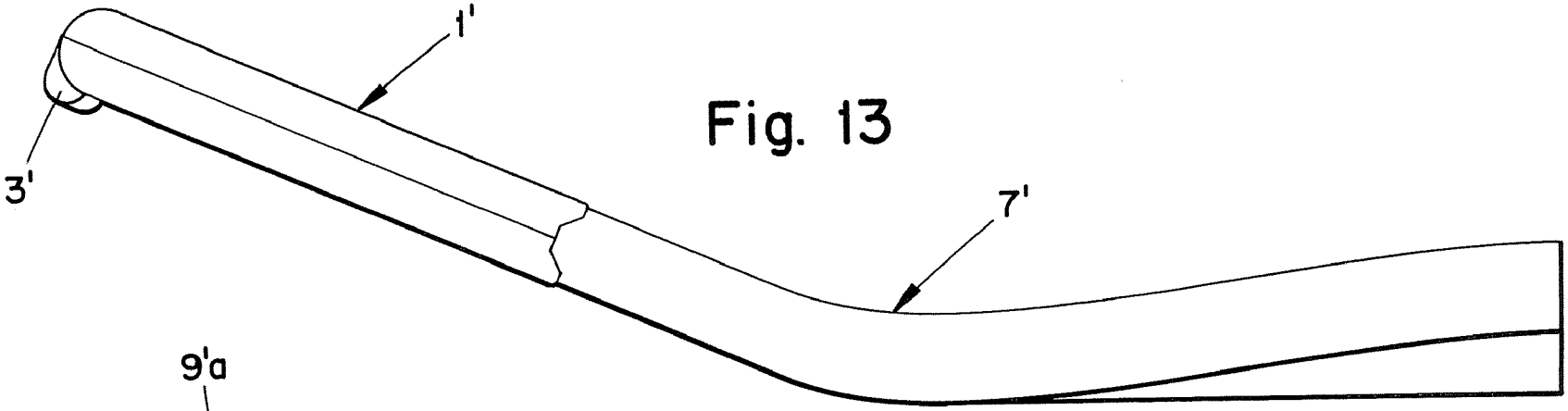
FIG. 13 shows in detail a side view of an end portion of a kicktail concave skateboard that is equipped with an element according to the present invention.

FIG. 13 shows in detail a kicktail of a skateboard that has been equipped with the element 1' according to the present invention. From FIG. 13 it can be seen that the element 1' is flush with adjoining portions of the blank 7', i.e., the volume of the element 1' corresponds to the material taken away in connection with creating of the recesses 9'*a* and 9'*b*. Thus, it is disclosed in FIG. 13 that the element 1' constitutes the edge portion of a skateboard according to the present invention.

Figure 14:
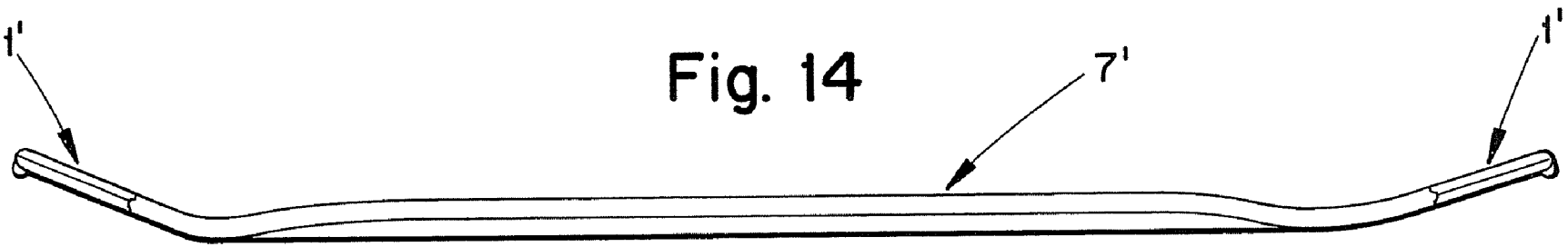
FIG. 14 shows a side view of a kicktail concave skateboard that at both ends is equipped with elements according to the present invention.
Figure 15:
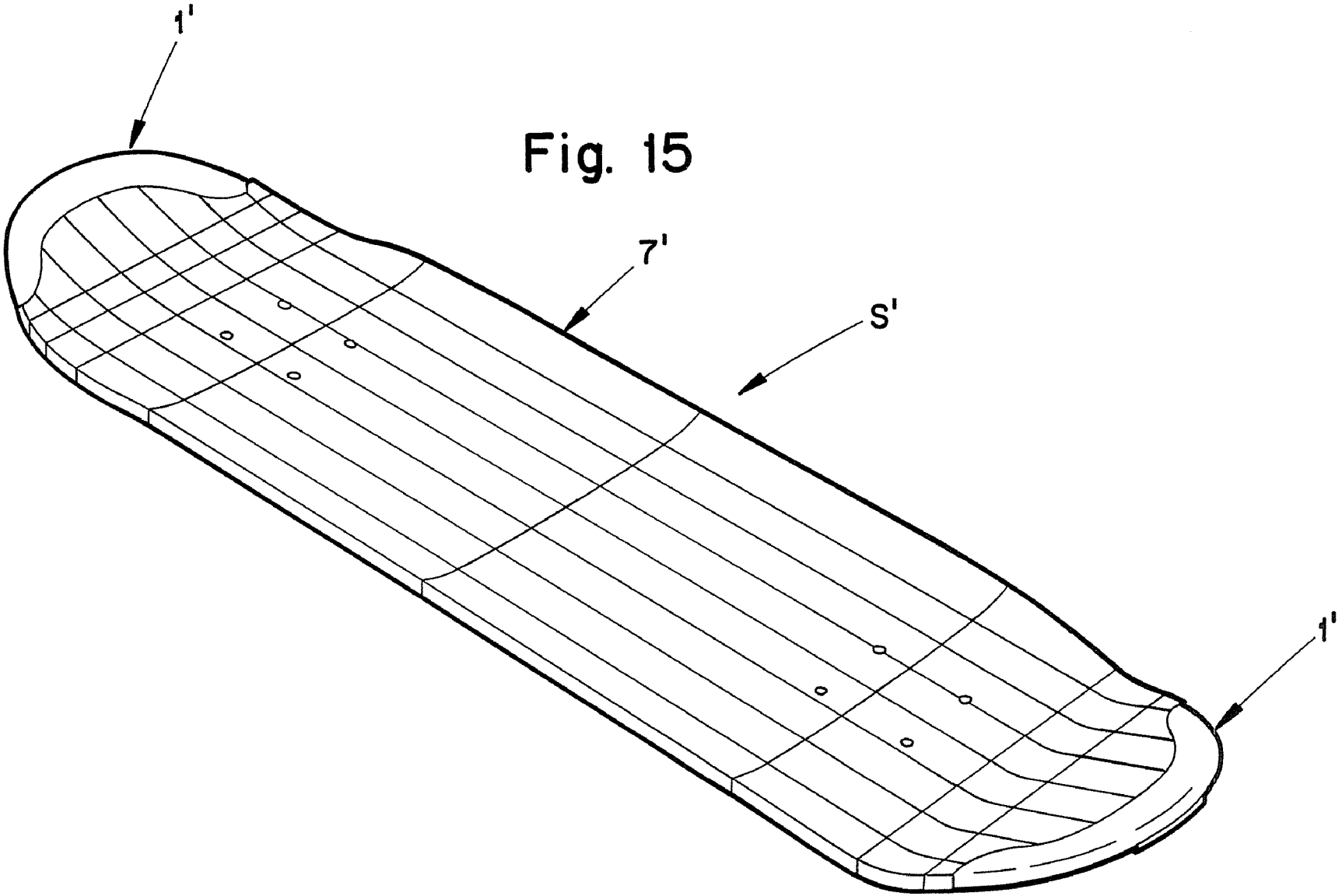
FIG. 15 shows a perspective view of a skateboard according to FIG. 14.

In FIGS. 14 and 15 a complete kicktail concave skateboard is shown, said skateboard being equipped with elements 1' according to the present invention at both ends. By a kicktail skateboard it should be understood a skateboard having at least one upwardly inclined end portion, preferably both end portions are inclined upwardly.

The skateboard according to FIGS. 14 and 15 is concave seen from above, i.e. the longitudinal edges are located at a higher level than the longitudinal intermediate portion of the skateboard.

FEASIBLE MODIFICATIONS OF THE INVENTION

Although it has been mentioned above that the blank is manufactured from a wooden material, preferably pressed maple, it is feasible within the scope of the invention that the blank constitutes a plastic composite material. In such a case the recesses are created in connection with injection molding of the blank.

In connection with the embodiment described in FIGS. 1-4 one or more recesses are provided in the blank, as steps of the manufacturing process of the skateboard. However, within the scope of the present invention it is feasible that the element or the elements that are mounted at the end portions of the blank could be integrated in the manufacturing process, i.e., laminated in the skateboard simultaneously as the wooden, preferably laminated, material or the plastic composite material in the rest of the skateboard is manufactured. As pointed out above a rectangular blank is normally received, said blank being machined to the desired shape. Thereby, also the reinforcing element will simultaneously be machined to its final shape, especially as regards the curvature of the outwardly facing free edge of said element.

Within the scope of the invention it is feasible that the element is fastened to the skateboard only by means of an adhesive. This is especially valid if the element is integrated in the skateboard in connection with its lamination.

What is claimed is:

1. A kicktail skateboard comprising:

a blank having opposite end sections and top and bottom surfaces, the end sections terminating in respective convex end edges, at least one of the end sections having a top recess formed in the top surface and a bottom recess formed in the bottom surface, wherein the one end section has a portion of reduced thickness defined by the top and bottom recesses, and a replaceable element including an upwardly facing side and a downwardly facing side spaced apart by a bridging portion, wherein the element has a generally U-shaped cross section and receives the reduced thickness portion such that the upwardly facing side and the downwardly facing side of the element are situated in the top and bottom recesses, respectively, wherein the upwardly facing side is substantially flush with the adjoining section of the top surface and the downwardly facing side is substantially flush with the adjoining section of the bottom surface, the bridging portion including a concave surface facing the convex surface of the blank's end edge, the element formed of a material having a lower mechanical damping capacity and higher modulus of elasticity than the blank, the downwardly facing side and the adjoining bottom surface section being unobstructed in the downward direction of the skateboard and exposed for directly contacting a skateboard-supporting surface during the performance of ollie maneuvers and sliding maneuvers of the skateboard.

2. An element adapted to be mounted on an end portion of a blank of a skateboard, the element being of U-shaped cross section including opposite top and bottom sides interconnected by an integral bridging element, wherein the top and bottom sides are generally flat, mutually parallel and spaced apart to form a space therebetween, the element being curved as seen in a direction perpendicular to the top and bottom sides wherein an outer surface of the bridging element is convexly curved, and an inner surface of the bridging element is concavely curved and forms a wall of the space, each of the top and bottom sides including an inner edge facing away from the bridging element, said inner edge including a center section of concave configuration as viewed in said direction and two end sections defined by junctions where the respective inner edges of the top and bottom sides intersect the bridging element, each of said end sections being of convex configuration as viewed in said direction, the element formed of a hard non-elastomeric material having low mechanical damping capacity and high modulus of elasticity.

* * * * *